US006487829B2

(12) United States Patent
Malloy

(10) Patent No.: US 6,487,829 B2
(45) Date of Patent: Dec. 3, 2002

(54) COMPOSITE CLADDING SYSTEM

(76) Inventor: Michael J. Malloy, 153 El Dorado La., Colorado Springs, CO (US) 80919

( * ) Notice: Subject to any disclaimer, the term of this patent is extended or adjusted under 35 U.S.C. 154(b) by 0 days.

(21) Appl. No.: 09/759,489

(22) Filed: Jan. 16, 2001

(65) Prior Publication Data

US 2001/0002527 A1 Jun. 7, 2001

Related U.S. Application Data

(62) Division of application No. 09/030,392, filed on Feb. 25, 1998, now Pat. No. 6,199,334.

(51) Int. Cl.[7] ..... E04G 23/00
(52) U.S. Cl. ..... 52/741.41; 52/745.1; 427/403
(58) Field of Search ..... 52/389, 443, 444, 52/454, 506.01, 745.09, 745.1, 741.41; 427/403

(56) References Cited

U.S. PATENT DOCUMENTS

| | | | | | |
|---|---|---|---|---|---|
| 748,634 | A | * | 1/1904 | Murphy et al. | 52/454 |
| 1,370,095 | A | | 3/1921 | Diercks | |
| 2,549,189 | A | | 4/1951 | Gabo | 428/116 |
| 3,021,916 | A | | 2/1962 | Kemp | |
| 3,667,159 | A | | 6/1972 | Todd | 428/116 |
| 3,742,930 | A | | 7/1973 | Ott | |
| 3,800,117 | A | | 3/1974 | Anderston | |
| 3,878,353 | A | | 4/1975 | Anderson | |
| 4,067,162 | A | | 1/1978 | Howorth | |
| 4,080,767 | A | | 3/1978 | Wilhelm | |
| 4,131,243 | A | | 1/1979 | Fries | |
| 4,292,775 | A | | 10/1981 | Howard | |
| 4,315,050 | A | | 2/1982 | Rourke | |
| 4,639,165 | A | | 1/1986 | Flecknoe-Brown | 428/116 |
| 4,581,864 | A | * | 4/1986 | Shvakhman et al. | 427/180 |
| 4,651,487 | A | * | 3/1987 | Nishikawa | 52/443 |
| 4,686,803 | A | | 8/1987 | Couderc et al. | |
| 4,889,758 | A | | 12/1989 | Rinkewich | |
| 4,944,127 | A | | 7/1990 | Clear | |
| 5,030,507 | A | | 7/1991 | Colvin et al. | 428/116 |
| 5,102,710 | A | | 4/1992 | Kaufman et al. | |
| 5,172,532 | A | | 12/1992 | Gibbar Jr. | |
| 5,180,619 | A | | 1/1993 | Landi et al. | |
| 5,256,007 | A | | 10/1993 | Allen | 428/117 |
| 5,265,579 | A | | 11/1993 | Ferrari | |
| 5,481,084 | A | | 1/1996 | Patrick et al. | |
| 5,506,031 | A | | 4/1996 | Spain et al. | |
| 5,540,023 | A | | 7/1996 | Jaenson | |
| 5,625,986 | A | | 5/1997 | Mansfield et al. | |

OTHER PUBLICATIONS

Arcat Alert–Fall 1996. Brochure 99 pages.

* cited by examiner

*Primary Examiner*—Michael Safavi
(74) *Attorney, Agent, or Firm*—Morgan & Finnegan, LLP

(57) ABSTRACT

A wall structure is formed with a decorative relief pattern milled into the outer facade forming a matte having a grid-like interconnective cellular structure. The matte is mechanically fastened to a wall structure and a layer of plaster material is set within the matte's cellular structure. An outer finish coat is applied to complete the cladding assembly. The matte being formed with first and second sets of cells extending from a side attached to the structure to an outer face thereof. The first set of cells are tapered having a narrow end adjacent the outer face and a wide end adjacent the wall structure. The second set of cells are tapered and having a narrow end adjacent the wall structure and a wide end adjacent the outer face. At least one first cell communicates with at least one adjacent second cell via a communication slot in the cell walls.

15 Claims, 3 Drawing Sheets

COMPOSITE CLADDING SYSTEM

This is a divisional of application Ser. No. 09/030,392, filed Feb. 25, 1998, now U.S. Pat. No. 6,199,334.

TECHNICAL FIELD OF THE INVENTION

This invention relates to cladding systems used in construction; more particularly, the present invention relates to cladding systems which provide decorative outer facades for wall structures, and the like.

BACKGROUND OF THE INVENTION

Imparting relief patterns into building surfaces traditionally was and still is labor intensive, and typically performed by craftsman trained to work with specific materials such as stone, wood, metal, terra-cotta and plaster. Even when labor was less expensive than it is today, the cost of covering an entire wall with a relief pattern was reserved for the most important structures such as churches, government buildings and homes of the wealthy. Otherwise pattern treatments were usually limited to trim, moldings and smaller panels set within larger flat wall surfaces. Presently, builders have several options for creating such relief patterns.

For example there are numerous manufacturers of specialty trims and moldings made from a variety of materials such as reinforced modified plasters, plastics, foams, wood press-board and modified and /or autoclaved cementitious materials. Molds and/or forming machines can readily be made to form patterns in the materials listed above. However, each mold represents a large tooling and prototyping expense. The expense and market research required to determine marketable relief patterns often times presents an unacceptable risk for most companies in today's ever changing and volatile consumer markets. At this time there are few, if any, manufacturers producing durable marketable cladding systems that allow for standard and custom relief patterns to be milled or carved into their surfaces.

For example, FUTURA COATINGS. INC. manufactures and distributes a coating system that is designed to be sprayed over foam substrates that may be sculpted, carved or cut. These foam substrates are shaped into sculptures, special theme park installations, decorative trim and other repetitive architectural elements and sprayed with a hard-shell polyurethane coating. The process of spraying polyurethane is expensive and must be applied in a controlled environment with special equipment and exhaust requirements. This limits the product's application to repetitive elements such as balusters, trim moldings or special environments such as theme parks and museums whose high degree of patronage can offset the relatively high costs. Similarly, several manufacturers, such as STO, DRVIT, and PAREX offer an E.I.F.S. (exterior insulation and finishing system) cladding material which utilizes acrylic modified plaster materials and reinforcing mesh designed to surface foam, wood or masonry substrates. Several companies, on a custom basis, will carve or route signage and other patterns into the foam substrate. The more complex the pattern, the more labor intensive and difficult it becomes to embed the reinforcing mesh within the base coat of the E.I.F.S. cladding material. Even moderately complex patterns make it difficult to use the heavier gage meshes that many end users require for durable surfaces required in high use and abuse areas. Consequently multiple layers of light gage mesh must be used to achieve high strength surfaces. This approach, however, increases labor and materials costs and can diminish the clarity in the relief pattern. Thus the majority of complex surface relief patterns in E.I.F.S. cladding systems are planar in nature and are achieved either by adding a second layer of foam over the base layer or by routing simple horizontal or vertical bands in the base foam layer. This approach is typically used for door and window trim casings or horizontal banding to provide interest on a particular building. More ornate patterns and signage are usually located in protected areas or higher locations where they are out of high traffic/impact areas. Also, manufacturers of concrete masonry units (C.M.U.) and autoclaved (high heat-steam cured) concrete cladding board products have introduced limited repeat patterns cast or molded into their surfaces. While some of these manufacturers have products with desirable patterns and shadow casting capabilities, they are limited in their diversity. This is due to tooling costs and the risk of committing to an expansive product line and inventory.

Also, a cellular structure panel has been used in various cladding systems. NORFIELD corporation manufactures a variety of panels, denoted NORCORE panels, that have a honeycomb plastic core material. The NORCORE panels are used as glue bonding surfaces for various veneers. However, the NORCORE panels do not provide for milling relief patterns into the panel. The NORCORE panels are not designed to have patterns etched or milled in their surfaces by traditional wood working tools. Further, the NORCORE panels are also not designed to retain plaster or other similar materials that change from an initially plastic state and cure or set into a monolithic, hard and durable material. The NORCORE panels do not allow for either uniform cell infill capability from one side or any type of inherent mechanical keying and infill retention features.

Thus there is a need for an economical, durable, impact resistant, hard coat cladding system that can economically receive an endless variety of low-medium relief patterns in its surface. A cladding system is needed which would allow contractors in the field to easily modify and size the cladding surface material with standard wood working tools as required by changing field conditions and the design parameters called for by the architects and designers. The present invention satisfies these needs and provides a new cladding system that can readily receive low to medium relief patterns on walls, columns, beams, and ceiling surfaces.

SUMMARY OF THE INVENTION

The present invention relates to an interior/exterior cladding system for providing a wall with a decorative outer facade. The invention includes a 3-dimensional, millable matte lath ("the matte") that utilizes existing plastering materials for infill. The matte allows for a variety of low to medium decorative relief patterns on wall, ceiling, column and beam surfaces. The matte is composed of an interconnective, grid-like, cellular structure. The matte is secured to a variety of sheathing (materials or stud/joists) substrates with standard fasteners. Plaster or other suitable material is set within the cells of the matte, essentially filling the majority of the cellular voids within the honeycomb structure. The routed surface of the matte will act as the screed point for the cellular infill material. In effect, the builder is tracing over the milled surface patterns with plaster.

The present invention provides developers, builders, architects and facility maintenance personnel with an economical and durable construction material that allows for decorative, low-medium relief patterns on its surface. The matte is provided in dimensions that are modular to standard framing spacing dimensions. Matte cladding panels can also be fastened to pre-fabricated sections of walls, in filled and finish coated in the factory or field environment and shipped to a construction site for final installation. Another variation would be to produce mattes with factory milled relief patterns within modular metal screed frames, braced, infilled and delivered to a job site where they would be clipped to typical sheathing and framing substrates. The finish coat could be either factory or filed applied. The present invention provides a new building medium for low to medium relief patterns which is economical, durable and requires no special equipment.

An object of the invention is to provide a durable, impact resistant, hard coat cladding system.

Another object of the invention is to provide a cladding system that will allow for economical formation of surface relief patterns and designs on the walls, columns, ceilings and beams of buildings.

Another object of the invention is to provide a cladding system which provides a virtually unlimited selection of pattern possibilities.

Another object of the invention is to provide the ability to cut mattes, size mattes and design patterns in the mattes in the field.

Yet another object of the invention is to provide a cladding system that can be economically milled and formed in the field to respond to unforeseen construction conditions where standard wood working tools may be used.

Another object of the invention is to provide the ability to economically upgrade, enhance and revitalize existing facilities by applying the cladding system directly over building surfaces.

A still further object of the invention is to provide a new material venue and creative outlet for architects and interior designers to impart meaning, specificity, contextualism and beauty in their design work.

Other objects, features and advantages of the invention shall become apparent when considered in connection with the accompanying illustrative drawings, detailed descriptions, non-limiting examples and claims.

DETAILED DESCRIPTION OF THE INVENTION

Referring to FIGS. 1–5, the invention pertains to a thermoplastic matte 12 used in conjunction with plaster to provide a wall with a decorative outer facade.

The Thermoplastic Matte

Figure 1:
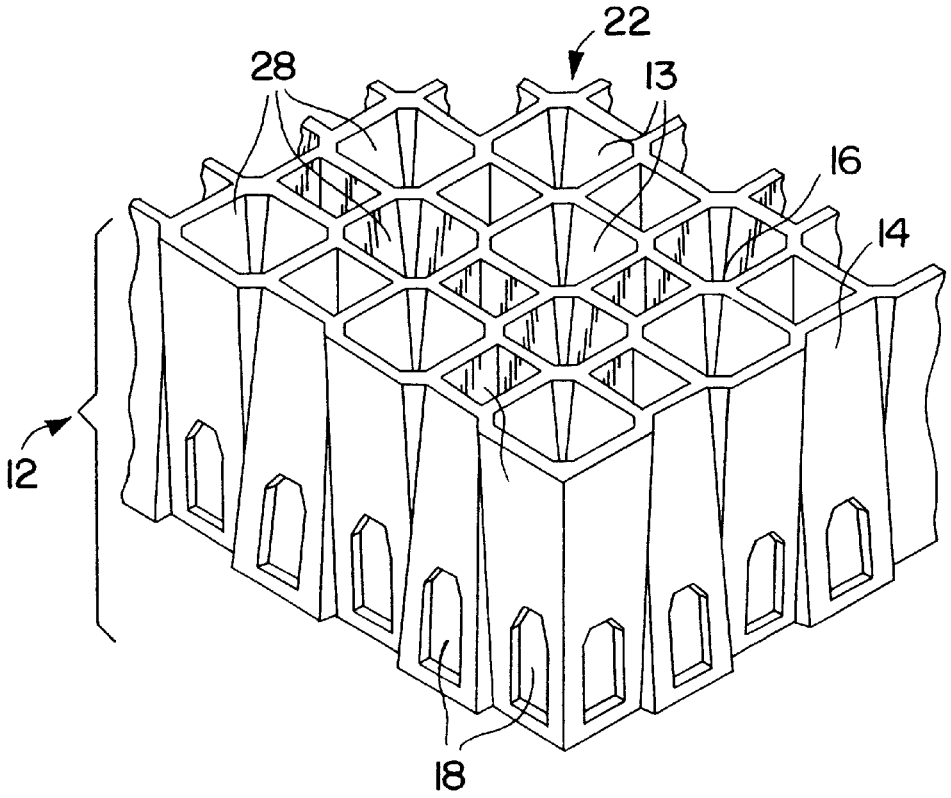
FIG. 1 shows a top perspective of the matte.

Referring to FIG. 1, the matte 12 is the primary component of the composite cladding system. The matte 12 acts as a formable/millable 3-dimensional lath for a variety of infill materials such as gypsum or plaster. The matte 12 is composed of a grid-like interconnective cellular structure where the cell's walls 14 have a uniform thickness. The cellular structure is formed by a plurality of cells which are voids in the matte 12. Overall, the cellular structure appears to be similar in appearance to a honey comb. The matte 12 has either a standard flat or milled relief pattern 40 on its outer surface 22.

The matte 12 is formed in an interconnected grid cellular structure. Individual cells are defined by four tapered walls 14 and mitered corner intersections 16. The thickness of the cell floors and walls 14 is uniform. For example 1/16" would be an appropriate thickness. The thickness of the cell wall 14 could be reduced to 1/32" for applications that require lighter materials. If the cell wall thickness is reduced, the type of mold, stiffness additive and molding process would be engineered to ensure consistent part release from the mold, machinability and consistency of wall thickness.

Figure 2:
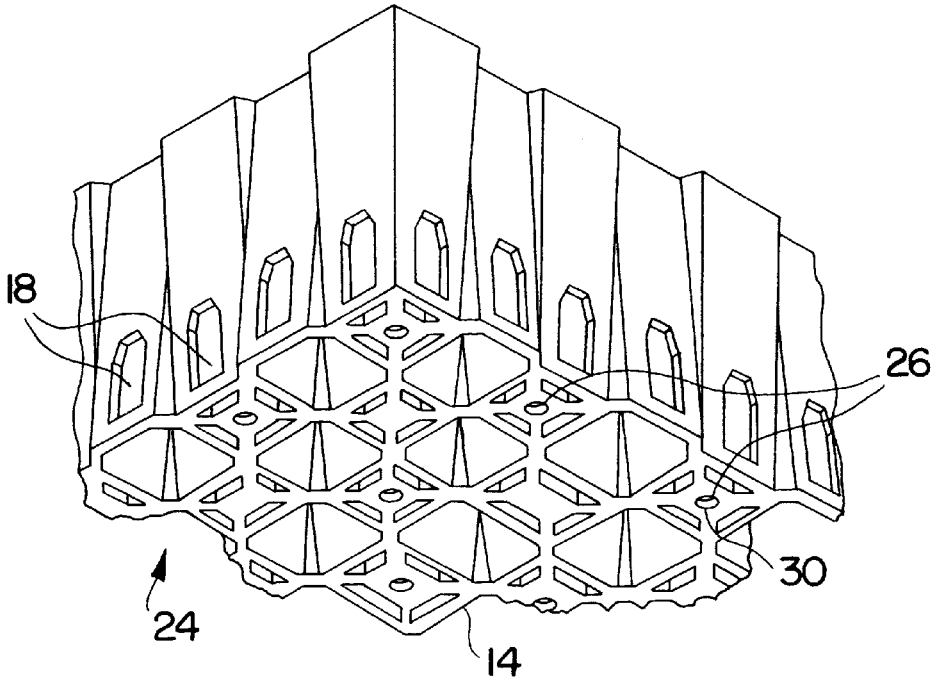
FIG. 2 shows a bottom perspective of the matte and the fastening sites provided in the matte

Each cell wall 14 contains a communicating slot 18 as seen in FIG. 2. These communicating slots 18 are typically 1/4" by 1/2" holes in the cell walls 14. The slots 18 allow the cellular infill 36, such as gypsum or plaster, to pass through the matte 12 thereby allowing physical continuity and positive mechanical cohesion of the infill material within the matte 12. Another important function of the communicating slots 18 is the ability to equalize air pressure within the thickness of the matte 12. This allows the infill material 36 to more completely fill each cell 13 by allowing air to escape and be replaced by the infill 36 as it is being sprayed or troweled on. Thus unwanted large air bubbles and incomplete infilling of cells 13 can be avoided and the complete bonding of cellular infill 36 material, to itself, at the communicating slots 18 is maximized. The cell walls 14 have alternating angles which act in unison with the communicating slots to provide a positive mechanical key, for the cellular infill 36 material, which together firmly locks and stabilizes the cellular infill 36 and matte 12 together into a composite assembly.

Figure 3:
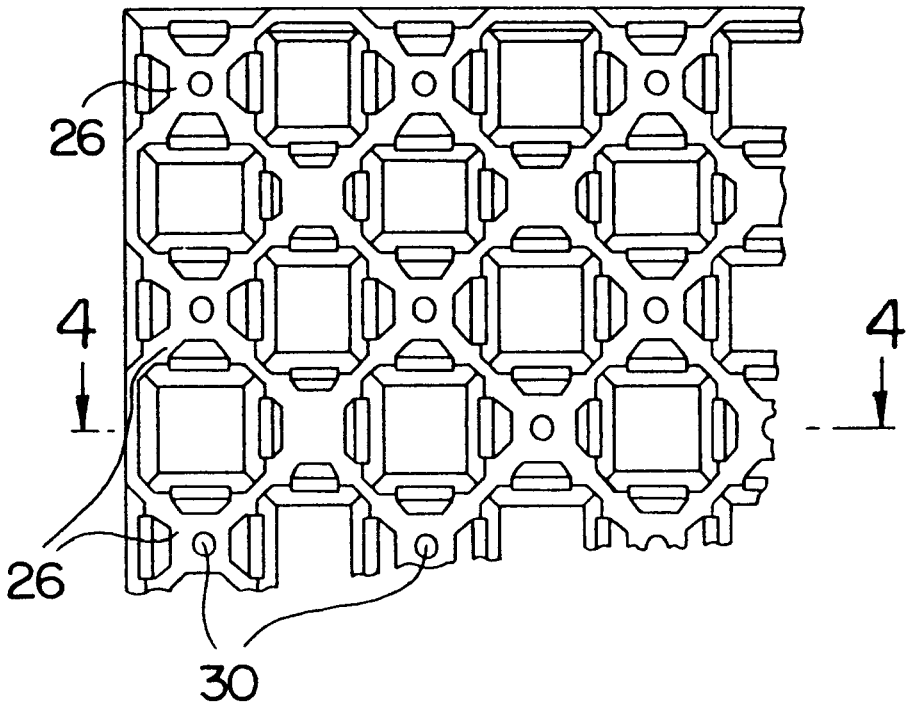
FIG. 3 is a bottom view of the matte and shows the mitered checker board pattern.

Overall, the cellular pattern of the matte 12 follows a 1/2" and 3/8" mitered checker board pattern as shown in FIG. 3. The 1/2" and 3/8" opening sizes were selected for their ability to allow for a broad range of pattern complexity, detail and clarity. A half scaled version of these dimensions, utilizing a cell pattern that follows a 1/4" and 3/16" mitered checker board pattern can be utilized for the creation of a finer, more refined and smaller scaled relief pattern. Applications for the half scaled matte would include some types of signage or more complex detail requirements that could not be as easily achieved using the full scale cell openings.

Figure 4:
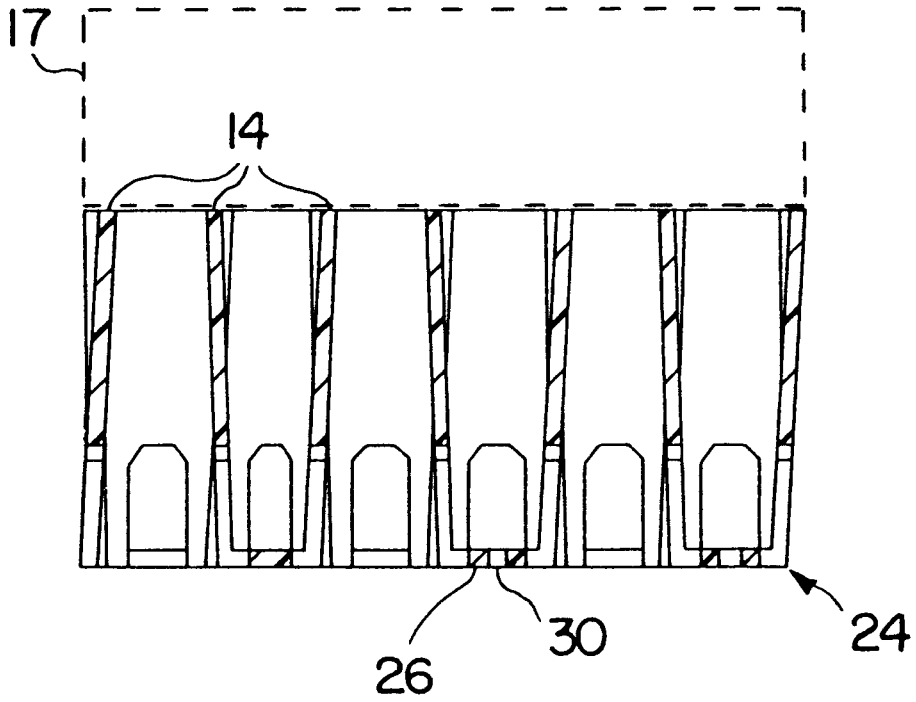
FIG. 4 is a cross-sectional view of the matte and shows the communicating slots between the cells. Also, the alternating cell walls are evident.

Referring to FIGS. 1 and 4, the pattern is evident on the outer face 22 and the fastening face 24 of the matte 12. The checkerboard pattern on the outer face 22 of the matte 12 is approximately the converse of the pattern on the fastening face 24 of the matte 12. Regarding the fastening face 24 of the matte 12, there are a plurality of fastening sites 26 provided to attach the matte 12 to a wall structure. The fastening sites 26 are located in the 3/8" squares in the mitered checkerboard pattern on the fastening face 24 of the matte 12. These fastening sites 26 consist of 3/32" holes 30 in the floor of the cells (which is also the fastening face 26 of the matte 12). The larger 1/2" openings 28 on the outer face of the matte 12 are designed to receive the dispensing tip of an automatic feed fastener gun. A gun will ensure rapid, proper alignment and placement of fasteners in the fastening sites 26.

Figure 5:
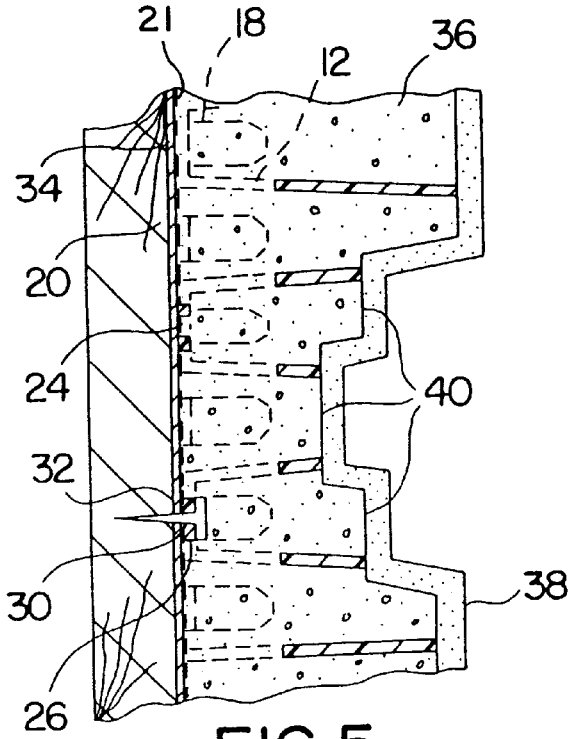
FIG. 5 is a cross-sectional view of the matte filled with plaster. The matte in this example is fastened to a plywood sheathing substrate by a nail fastener. The outer face of the matte shows a pattern cut into the matte.

As shown in FIG. 5, fasteners include nails 32 and or screws. Other methods of fastening, such as standard drills with long Phillips or Allen head drive bits for these types of fasteners or modified nail and screw guns can be used as well. A matte 12 can also be mounted utilizing a glue type of application to the sheathing substrate. In exterior environments, a fully adhered or fluid applied water proofing membrane is applied to the sheathing prior to installation of the matte 12.

Specifically, the matte 12 is embodied in 4'×8' or 4'×4' panels with varying thickness. While these sizes are not mandatory, they are derived from the conventional sizes of other cladding materials and share the same economy of labor and conformity to typical wall and ceiling joist framing spacing commonly used in construction (e.g. 16"). Smaller panel sections or tiles can be either molded or cut with a variety of edge treatments creating a modular or free-form tile panel system. Tiles could be pre-filled and finish coated or installed and finished as has been indicated above. As seen in FIG. 5, the thickness of the matte 12 will vary between ¾" to 2½"; ¾" is the minimum depth of intact un-cut matte 12, as measured from the fastening face 24 side of the matte 12, the minimum standard thickness for flat (un-milled) applications and for pattern formations achieved by building up successive layers.

For factory milled pattern applications, the standard thickness will be 1 ½" to 2½" thereby allowing ¾" to 1¾" depth to develop patterns. These specifications are not fixed but provide general guidelines. In alternate embodiments, mattes 12 are produced in larger sizes to accommodate larger area coverage requirements.

The matte 12 is composed of a performance modified nylon or other thermoplastic material. Other thermoplastic materials may be used providing that the material can be altered to possess specific performance characteristics. In particular other thermoplastics in general can receive additives to the raw material before processing and molding, that can positively alter the physical and performance characteristics of the unaltered raw material.

These performance characteristics include sympathetic thermal expansion properties with the cellular infill 36 material used, strength/stiffness, crisp milling and shaping capability, fire retardant, color and weatherability. These performance characteristics will be specifically engineered by plastic molding and formulation engineering. In general, they must be evident in the final thermoplastic formulation used for the matte 12. The main performance characteristics to be incorporated are:

1. Thermal expansion: It is desirable to match as closely as possible, the thermal coefficient of expansion of the infill material (e.g. plaster) with the matte 12 material. For example several mineral additives, such as gypsum can be added to modify a thermoplastic s coefficient of thermal expansion. Most of these mineral additives are less expensive than the thermoplastic itself.
2. Strength/stiffness: Strength and stiffness must be balanced so as to prevent matte 12 surface deformation during milling, sagging in horizontal applications (e.g. ceilings) and to prevent the matte 12 from deforming under troweling pressure. For example, the proper balance of these characteristics can be attenuated with additives such as fiberglass.
3. Crisp milling and machining capability: The material for the matte 12 must be stiff enough to maintain its molded cellular form and crisp edge lines of milled patterns as routers and saws cut through the matte 12. The molecular structure should be such that the material as it is milled, peels away in a precise and predictable manner.
4. Fire Retardant: It is common in building construction that particular walls require fire ratings. Where needed, the matte 12 can have added or increased fire retardance as required by the particular code requirements. For example Nylon, being a primary candidate, is in itself self extinguishing while other potential thermoplastic candidates are not. Fire retardant additives are commonly used to modify Fire Resistive properties of many thermoplastic materials and can be added to nylon as well to increase fire resistive properties.
5. Color: Matte color selection should be based on specific marketing criteria and can have a distinct enough contrast to the color of the cellular infill 36, so as to aid in the visual confirmation of complete infilling of the cells 13 at the outer face 22.
6. Weatherability: In most, if not all instances, ultra violet degradation will not be a concern as the finish coat 38 will protect the matte 12. An inherent or performance modified ability to resist freeze thaw cycling, mineral salts and to maintain long term (40 to 50 years.) molecular resiliency under constant thermal expansion and contraction should be planned for in the thermoplastic a lot. The thermoplastic material selected for use in the matte 12 must exhibit an ability to resist these affects.

The matte 12 may be formed by one of the following processes, each with its own advantages and disadvantages: injection molding with hot runners, structural foam molding, casting, compression molding or vacuum forming. While injection molding would likely yield the most consistent part, the mold costs and the size of the press required, would make it the most expensive process to initiate. However, once the investment has been made in a sound mold and press, the part quality, rate of output and the life span of the mold are excellent. The 1/16" cross section of the matte 12 is slightly below recommended minimum thickness for structural foam molding. However, if mold consistency and foaming agent ratios are carefully engineered, this process could yield a quality part equal or similar to injection molding with reduced costs for mold, mold press, materials and finished part weight. Casting can produce high quality parts with much less expensive mold costs but has a comparatively smaller rate of part output in comparison to injection molding. Vacuum forming and compression molding are two other candidates whose initial mold costs are less expensive than injection molding. The formation of some of the matte's 12 features such as the communicating slots 18 and fastening sites 26 will present a challenge that careful plastic and mold engineering could likely solve with little if any compromise. In the final analysis, initial mold costs, mold life span, part output, individual process limitations, amount of secondary machining and overall process costs must be weighed together in selecting the right molding process.

The Composite Cladding System

Referring to FIG. 5, the matte 12 is mechanically fastened to a wide variety of wall structures 20. For example the wall structure 20 can be a wall, ceiling, column, beam, or a framing system. Also, a sheathing substrate 34 such as plywood or gypsum board may be applied to the wall structure 20 before attaching the matte 12. Further, in retrofit situations, existing building cladding materials are often suitable substrates provided they have a flat surface and are able to receive and retain matte fasteners. The mattes 12 can be utilized in either exterior or interior environments.

Once the mattes 12 are in place, a spray or hand applied cellular infill 36, such as cementitious or acrylic modified/ plaster, is set within the thickness of the mattes 12 cellular structure. This creates an economical, hard-coat flat or relief patterned finished surface. The matte 12 is typically filled with ¾" to 2½" of cellular infill 36. Cellular infill 36 material, whether it is hand or spray applied, will require hand troweling to fully compact and compress it within each cell 13; similar to the typical activity used in laying up a traditional plaster wall. This action will remove the majority of air from within the cell 13, thereby filling the cell 13 down to the fastening face 24 side of the matte 12. A small air void at the very bottom of the cells 13, will have no effect on the composite integrity of the finished cladding system and will in fact assist in the desirable migration and removal of any latent moisture migrating it's way into the cladding assembly. The important point is to compress the cellular infill 36 down to the bottom of the communicating slots 18, thereby allowing the cellular infill 36 material to bond to itself within the thickness of the matte 12. Once the infill 36 has cured, the exposed surface will display the milled relief pattern and the planar honeycomb geometry of the cell walls. In interior dry environments, the surface can be left as is or clear sealed for its design effect. In most situations though, a final finish coat 38 will be applied to complete the cladding assembly. Cellular infill 36 may be acrylic plaster, cementitious plaster, acrylic modified plaster, gypsum plaster, Keene's plaster, and Gunite. Other products maybe used provided they have the desired finish surface and weathering characteristics. Applying cellular infill 36 by spray is the most efficient and cost effective method. However, the traditional method of hand troweling is acceptable. A final finish coat 38 will complete the composite assembly. The finish coat 38 may be an acrylic textured paint, an acrylic modified or cementitious plaster color coat, a commercial grade elastomeric coating, drywall joint compound and paint, a gypsum plaster color coat, a duplicate, a 100% acrylic plaster color coat or a textured paint. The economic way of applying the final finish coat 38 is to spray it but, hand application is acceptable. Through careful selection of the finish coat 38, the cladding system may be used to compliment existing cladding systems.

Exterior applications also include applying a waterproof membrane (shown at 21 in FIG. 5) between the matte 12 and substrate. The waterproof membrane may be chosen from a wide range of existing commercially available vapor barriers, building papers and waterproof membrane products. Exterior assemblies may also utilize metal trim, expansion joints, casings, and screeds etc. as required to accommodate thermal movements and moisture control. Interior assemblies and exterior ones differ primarily in the types of cellular infill materials. Also for interior assemblies, the waterproof membrane is eliminated (except in high moisture areas).

Decorative Patterns

Figure 6:
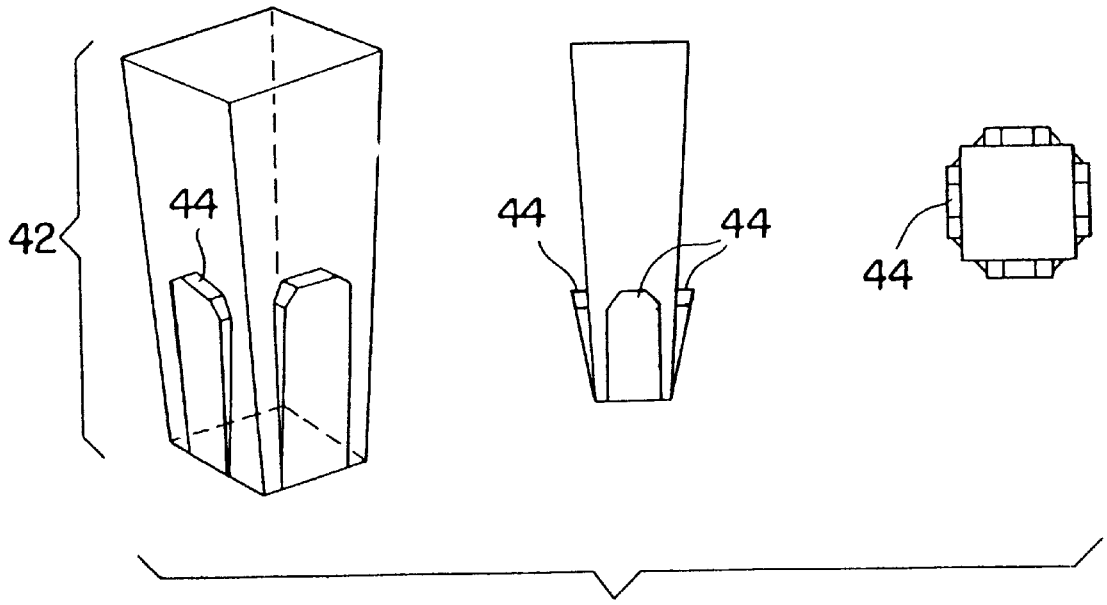
FIG. 6 is a top perspective of an infill plug contained in the matte.

The primary method of cutting relief patterns is by using a CAD/CAM design and production system that directs a high speed CNC Overhead Router to mill/route patterns in the surface of the matte 12. In FIG. 5, the line 40 of the milled pattern can be seen. A wide variety of router bit profiles can be employed in the formation of relief patterns on the surface of the matte 12. The router bit turret on CNC routers can contain 10 or more different bits and corresponding profiles. These can be changed automatically at high speed to complete a wide variety of cut profiles. The patterns may be obtained from standard pattern libraries or custom pattern requests. The patterns may appear solitary or repeat over the entire wall. The matte 12 can also be distributed as flat—unmilled, un-marked panels upon which builders can modify themselves by doing their own pattern layout with paint on the face of the panel. A builder may cut into the surface of the matte 12 with a hand held or portable table router. Spray painted guide lines could provide the cutting instructions in the "field cut" option Alternatively, a pattern may be created using a "successive layer" method. The matte 12 panels may be distributed with factory spray paint applied color coded routing and alignment pattern guides which indicate the specified pattern, successive layer piece location, depth of cut and edge profile. These patterns are applied and effectuated by a CAD/CAM paint application system. These spray painted guide lines provide a location guide in the "successive layer" option. In this option, a secondary layer of either field or factory cut matte 12 panels are fastened to a base layer of matte 12 panels, thereby creating a built up relief pattern. These spray painted routing and alignment patterns along with a numeric piece key numbering system will facilitate field installation. Referring to FIG. 6, panels built up in successive layers shall be fastened to the base matte 12 sheet by utilizing a cellular infill plug 42 to be placed in base sheet cells beneath secondary panel fastening locations. The infill plug 42 will have the exact interior dimensions as a typical fastening cell 28; and once pressure snapped into place, becomes a solid backing to fasten through. Fasteners from secondary panels shall fully penetrate infill plug 42 and extend into the sheathing or framing substrate. The locking projections 44 of the infill plug 42, snap into the communicating slot 18 on all four sides of the fastening cells at the larger ½" openings 28. The quantity of fastening locations for securing the secondary matte to the base matte 12 should be such that the secondary matte is held securely to base matte 12 during the cellular infill 36 application and subsequent curing. Once cured or set, the mattes will be bonded together monolithically. Additionally, a secondary cladding element can be attached to the outer face of a primary cladding element as shown at 17 in FIG. 4. As stated above, it is important that infill material 36 fully penetrates to the bottom of each cell for complete bonding of infill material to occur. Further, standard and custom trim pieces along with modular tile systems can be developed as additional product lines that are compatible and interchangeable with the larger scale 4'×4' and 4'×8' matte 12 sizes.

While advantageous embodiments have been chosen to illustrate the invention, it will be understood by those skilled in the art that various changes and modifications can be made therein without departing from the scope of the invention as defined in the appended claims.

What is claimed is:

1. A method of cladding a building surface comprising the steps of:

(a) fastening a cladding element to a wall structure, the cladding element comprising an outer face, an opposing fastening face, and a plurality of adjacent cells; and (b) filling at least one of said plurality of cells with a cellular infill;

wherein said cells extend from the outer face to the fastening face of the cladding element and include an opening at the outer face;

wherein said cladding element includes a first set of cells and a second set of cells, cells in the first set being tapered and having a narrow end adjacent the outer face and a wide end adjacent the fastening face, cells in the second set being tapered and having a narrow end adjacent the fastening face and a wide end adjacent the outer face; and wherein each cell of the first set is adjacent at least one cell of the second set, and each cell of the second set is adjacent at least one cell of the first set.

2. A method of cladding a building surface comprising the steps of:

(a) fastening a cladding element to a wall structure, the cladding element comprising;

an outer face, an opposing fastening face, and a plurality of adjacent tapered cells, each cell being surrounded by cell walls, wherein the cell walls extend between the outer face and the fastening face, wherein each cell shares a common wall with each adjacent cell, wherein each tapered cell has opposite ends and each end has a geometrical size, wherein each adjacent cell end has a different geometrical size than each neighboring adjacent cell end, and wherein at least a first cell of said plurality of cells communicates with at least one adjacent second cell via a communication slot in the cell walls;

(b) filling the first cell with a cellular infill.

3. A method according to claim 2, wherein the wall structure is a wall, a ceiling, a column, a beam, a joist, a stud, or a framing system.

4. A method according to claim 2, wherein filling includes spraying or manually applying the cellular infill to the cladding element.

5. A method according to claim 2, further comprising:

hand troweling cellular infill into the cells.

6. A method according to claim 2, further comprising:

filling the at least one adjacent second cell with cellular infill so that the cellular infill in the first cell and second cell communicates via the communication slot.

7. A method according to claim 6, further comprising:

curing the cellular infill so that the cellular infill in said first and second cells bonds across the communication slot.

8. A method according to claim 2, wherein the cellular infill comprises acrylic plaster, cementitious plaster, acrylic modified plaster, gypsum plaster, Keene's plaster, or Gunite.

9. A method according to claim 2, further comprising:

milling or routing a relief pattern into the cladding element, wherein the cladding element is millable or routable.

10. A method according to claim 2, wherein fastening includes inserting a nail or a screw through the cladding element's fastening face and into the wall structure, thereby attaching the cladding element to the wall structure.

11. A method according to claim 2, wherein the cladding element is a primary cladding element, the method further comprising:

fastening a secondary cladding element to the outer face of said primary cladding element.

12. A method according to claim 11, further comprising:

inserting a cellular infill plug into at least one primary cladding element cell prior to attaching the secondary cladding element to the primary cladding element at the cellular infill plug.

13. A method according to claim 2, further comprising:

applying a sheathing substrate to said wall structure before fastening the cladding element to the wall structure.

14. A method according to claim 13, further comprising:

applying a waterproof coating to the sheathing substrate before fastening the cladding element to the wall structure.

15. A method according to claim 2, further comprising: mounting thermal movement or moisture control devices on the wall structure.

* * * * *